US007362235B1

(12) United States Patent
Normann et al.

(10) Patent No.: US 7,362,235 B1
(45) Date of Patent: Apr. 22, 2008

(54) IMPEDANCE-MATCHED DRILLING TELEMETRY SYSTEM

(75) Inventors: Randy A. Normann, Edgewood, NM (US); Arthur J. Mansure, Albuquerque, NM (US)

(73) Assignee: Sandria Corporation, Albuquerque, NM (US)

( * ) Notice: Subject to any disclaimer, the term of this patent is extended or adjusted under 35 U.S.C. 154(b) by 428 days.

(21) Appl. No.: 10/438,999

(22) Filed: May 15, 2003

Related U.S. Application Data

(60) Provisional application No. 60/378,086, filed on May 15, 2002, provisional application No. 60/378,034, filed on May 15, 2002.

(51) Int. Cl.
*G01V 1/00* (2006.01)

(52) U.S. Cl. ..... 340/854.8; 340/855.1; 166/65.1; 166/592

(58) Field of Classification Search ..... 340/854.8, 340/855.1; 439/191, 194; 166/592, 65.1
See application file for complete search history.

(56) References Cited

U.S. PATENT DOCUMENTS

| | | | | |
|---|---|---|---|---|
| 2,178,931 | A | | 11/1939 | Crites et al. |
| 2,379,800 | A | | 7/1945 | Hare |
| 2,531,120 | A | | 11/1950 | Feaster |
| 2,748,358 | A | | 5/1956 | Johnston |
| 3,090,031 | A | | 5/1963 | Lord et al. |
| 3,107,137 | A | | 10/1963 | Bates et al. |
| 3,518,608 | A | | 6/1970 | Papadopoulos |
| 3,518,609 | A | | 6/1970 | Fontenot, Jr. |
| 3,696,332 | A | | 10/1972 | Dickson et al. |
| 3,807,502 | A | | 4/1974 | Heilhecker et al. |
| 3,879,097 | A | | 4/1975 | Oertle |
| 3,904,840 | A | | 9/1975 | Kostelnicek |
| 4,095,865 | A | | 6/1978 | Denison et al. |
| 4,215,426 | A | | 7/1980 | Klatt |
| 4,445,734 | A | | 5/1984 | Cunningham |
| 4,605,268 | A | * | 8/1986 | Meador ..... 439/194 |
| 4,788,544 | A | * | 11/1988 | Howard ..... 340/853.7 |
| 4,792,802 | A | | 12/1988 | Meadows |
| 4,852,648 | A | | 8/1989 | Akkerman et al. |
| 4,901,069 | A | * | 2/1990 | Veneruso ..... 340/854.8 |
| 5,008,664 | A | | 4/1991 | More et al. |
| 5,052,941 | A | | 10/1991 | Hernandez-Marti et al. |
| 6,392,317 | B1 | * | 5/2002 | Hall et al. ..... 307/90 |
| 6,516,880 | B1 | | 2/2003 | Otten et al. |
| 6,670,880 | B1 | | 12/2003 | Hall et al. |

OTHER PUBLICATIONS

Michael J. Jellison, et al, Telemetry Drill Pipe: Enabling Technology for the Downhold Internet, SPE/IADC 79885, Copyright 2003 SPE/IADC Drilling Conference, The Netherlands Feb. 19-21, 2003.

* cited by examiner

*Primary Examiner*—Timothy Edwards, Jr.
(74) *Attorney, Agent, or Firm*—Russell D. Elliott; George H. Libman

(57) ABSTRACT

A downhole telemetry system that uses inductance or capacitance as a mode through which signal is communicated across joints between assembled lengths of pipe wherein efficiency of signal propagation through a drill string, for example, over multiple successive pipe segments is enhanced through matching impedances associated with the various telemetry system components.

6 Claims, 7 Drawing Sheets

IMPEDANCE-MATCHED DRILLING TELEMETRY SYSTEM

This application claims the benefit of U.S. Provisional Application No. 60/378,086, filed May 15, 2002 and U.S. Provisional Application No. 60/378,034, also filed May 15, 2002, and which are both herein incorporated by reference in their entirety.

This invention was made with support from the United States Government under Contract DE-AC04-96AL85000 awarded by the U.S. Department of Energy. The Government has certain rights in this invention.

BACKGROUND OF THE INVENTION

1. Field of the Invention

This invention pertains generally to the field of communications in oil and gas drilling operations and other similar activities in which exchange of information is required between the earth's surface and regions downhole. The invention described in this application utilizes inductive or capacitive coupling at joints between sections of pipe, impedance matching and coil (or capacitor) shielding to minimize attenuation and reflection of signal to afford effective real-time or near-real-time communications in a high-speed, robust system that conveniently integrates into current drilling practices and other downhole applications.

2. Description of the Related Art

Presently, a common mode of communicating information between downhole regions and the surface is mud-pulse telemetry. In this technique, a valve downhole opens and closes creating backpressure pulses in the mud being pumped down the drill pipe. A pressure transducer at the surface measures these pulses reading the signal from downhole. Although this method is commonly used, it suffers from low bit rate (<10 bits per second) and communications are uni-directional.

Other wireless systems such as EM or Earth Current systems that transmit through the earth have also been built, but their performance is no better than mud-pulse telemetry. These systems are also less reliable, depending on the types of formation drilled through.

There have been numerous attempts to add wire to drill pipe including the use of slip rings at joints (physical contact/connection) and inductive coupling at the joints. Active electronics at the joints including use of Hall effect sensors has been proposed. Slip rings are not robust, requiring special care while making up the joints. The inductive coupling concepts proposed previously have not resolved issues relating to of how to control/minimize reflections of the signal at the joints. Consequently, issues relating to signal attenuation continue to plague many downhole telemetry systems. Additionally, active electronics add cost and complexity to systems. For example, for 20,000 feet of drill pipe, 650 sets of electronics and batteries may be necessary using systems based on active electronics. If just one electronic package or battery fails, the whole system fails.

SUMMARY OF THE INVENTION

The present invention is a downhole telemetry system that uses inductance or capacitance as a mode through which signal is communicated across joints between assembled lengths of pipe. Wire is used to transmit signal within each length of pipe. Efficiency of signal propagation through a drill string, for example, over multiple successive pipe segments is enhanced through matching impedances associated with the various telemetry system components, including designing the various components and operating frequencies to have a broad response rather than a narrow operating band, and partially enclosing the inductance coils or capacitance plates used for transmitting signal across pipe joints with materials selected and positioned to focus magnetic flux, thereby reducing loss of signal at the joints through reflectance and other similar phenomena. In one embodiment of the invention, signal propagation across joints is further enhanced through the addition of loops to coils on the receiving end of a joint, as compared with those on the sending end.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

Inductive or capacitive coupling in drilling telemetry removes the need to have direct electrical contact at the pipe joints. For reasons of robustness and simplification this can benefit the drilling process substantially by allowing high-speed communication that is virtually invisible to the conventional drilling operation.

A well-designed telemetry drill pipe allows for the concealment and protection of wire coils between the pipe joints, since inductive (or capacitive) coupling conceals and protects the link across the pipe joints. In the case of inductive coupling, two coils (referred to in this disclosure as signal transformers), one located in each pipe end, permit wireless communication across tool joints. In such an instance, transformer windings face each other and are able to transfer electrical signals as a result of inductance phenomena. In the case of capacitive coupling, electric charges on a capacitive plate the end of a pipe induce a signal in another plate located near, but not touching the first plate. In either case, wireless communication across tool joints is made possible. In the present invention, propagation of signal is enhanced through the combination of factors.

Impedance Matching The present invention differs from existing inductive (and capacitive) telemetry systems in part due to recognition that signal losses occur when impedances of various components of the system lack consistency along the path through which the signal must travel. In order to understand impedance matching it is helpful to consider the overlap of center frequencies between coils used in a telemetry system.

Figure 1:
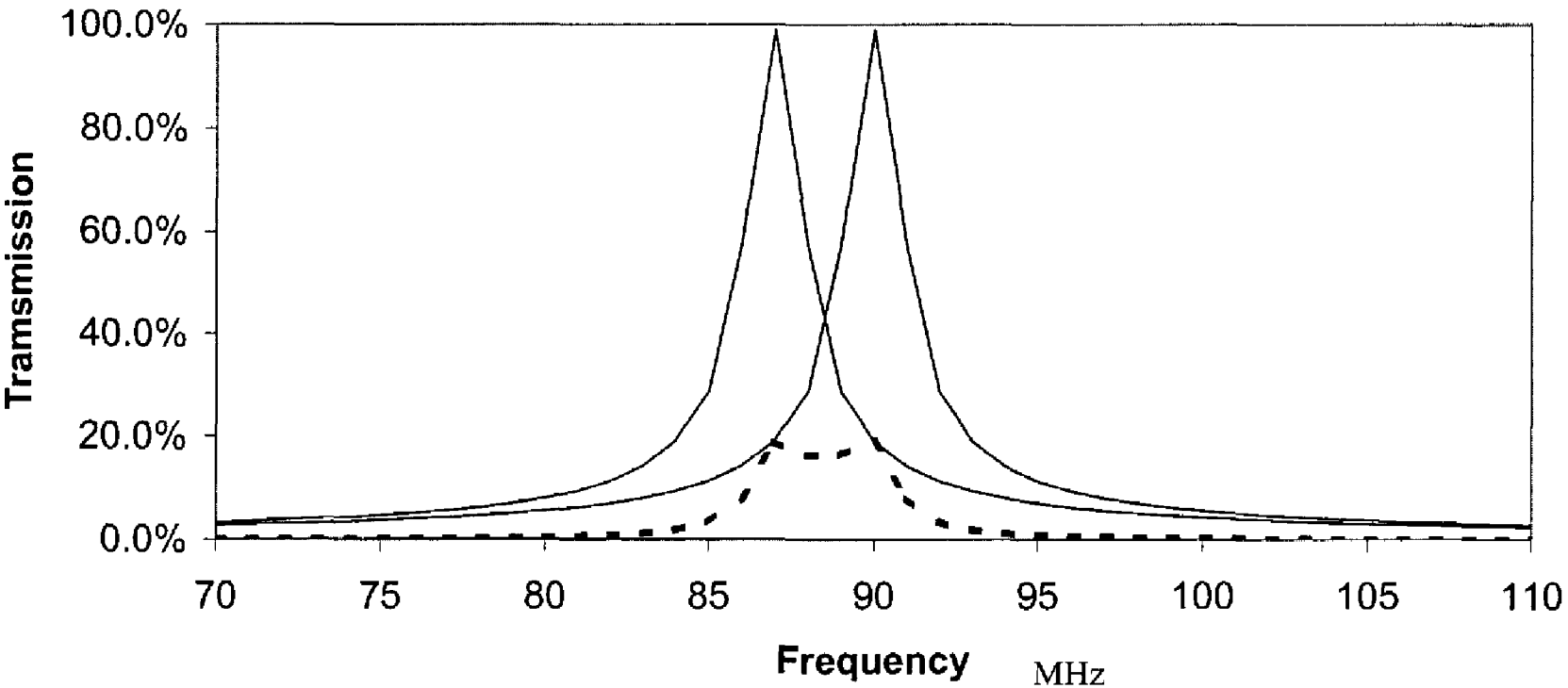
Fig. 1 (Prior Art)
FIG. 1 shows a typical transmissivity plot for a prior art telemetry system that uses high frequency inductive coils.

Much attention has been paid previously to attempting to drive the inductive coils in resonance, but at the expense of neglecting the other system elements. Consequently, systems have been devised apart from this invention that are characterized by high operating frequencies (e.g. in the mHz range) and a system tuned to a narrow operating band. As can be seen from FIG. 1 (Prior Art), systems can be designed wherein the two inductive coils in series exhibit high transmission (approaching 100%) at high frequencies. However, typically, the performance curves in those instances are steep signifying that the high levels of response are observed over only a low range of frequencies. Consequently, the range over which two coils in series are actually transmissive is small; greatly diminished as compared with the transmission associated with the coils individually. This is illustrated by the dotted line curve in the figure meant to show, roughly, the range in which the two coils are actually transmissive. Moreover, where high frequencies are used and a system is tuned to narrow operating bands, the system is often very sensitive to manufacturing and assembly variations.

Figure 2:
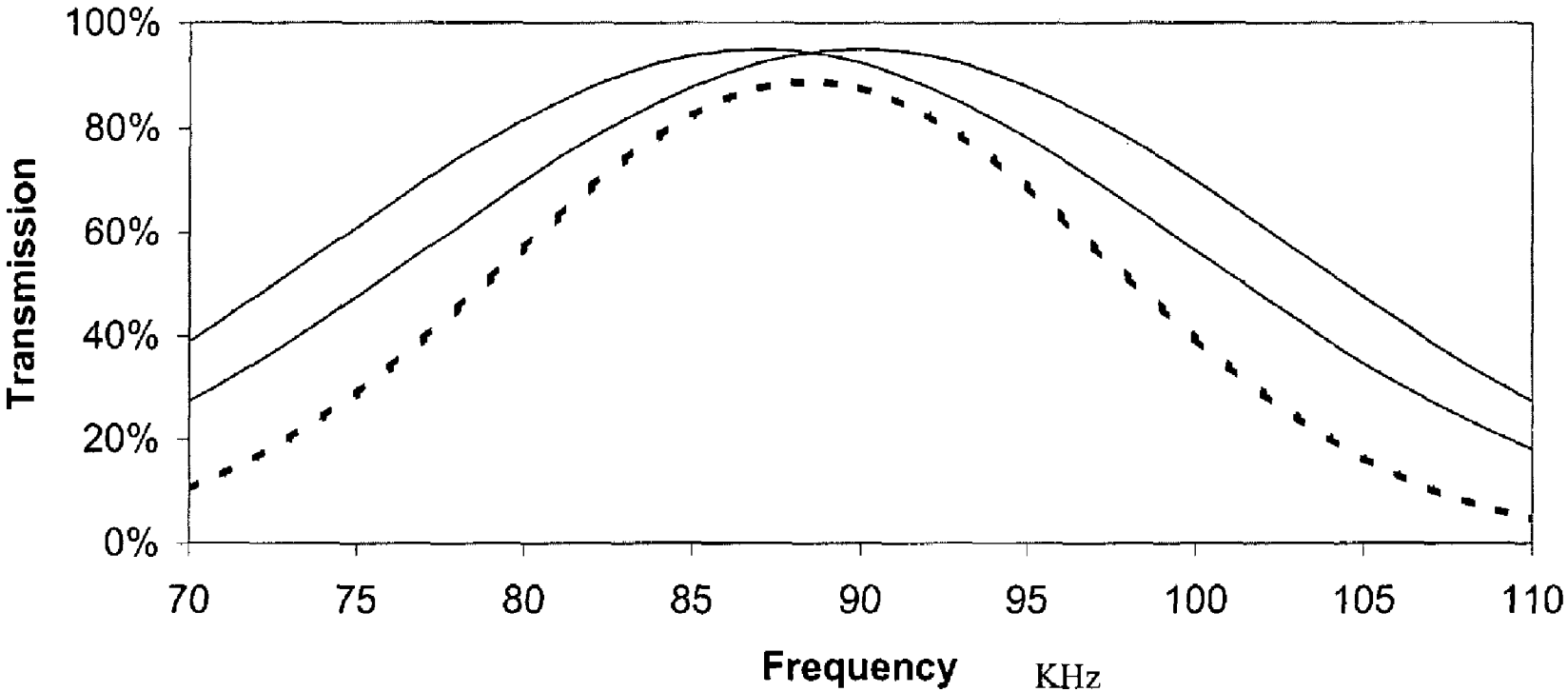
FIG. 2 shows a transmissivity plot for an inductive telemetry system with a broad response.

On the other hand, FIG. 2 illustrates a preferable situation in which coils and other elements of the telemetry system are selected to exhibit a broad response, even though less attention devoted to high frequency operation or transmission efficiency approaching 100%. In the case of the curves in FIG. 2, the two curves signifying the range at which two coils in series are individually transmissive is broader than for those shown in FIG. 1, and the peak transmission is lower. Nonetheless, the range over which both coils in series are transmissive (shown by the dotted line) is higher in FIG. 2 than in FIG. 1, and the peak transmissivity is likewise higher. This signifies that increased bandwidth can be achieved when a system design accounts for the periodic nature of the system components (many inductors and wires in series) and impedance matching is used as described in this disclosure. In general, improved bandwidth is observed if coils operate in the hundreds of KHz range rather than in the MHz range.

Figure 3:
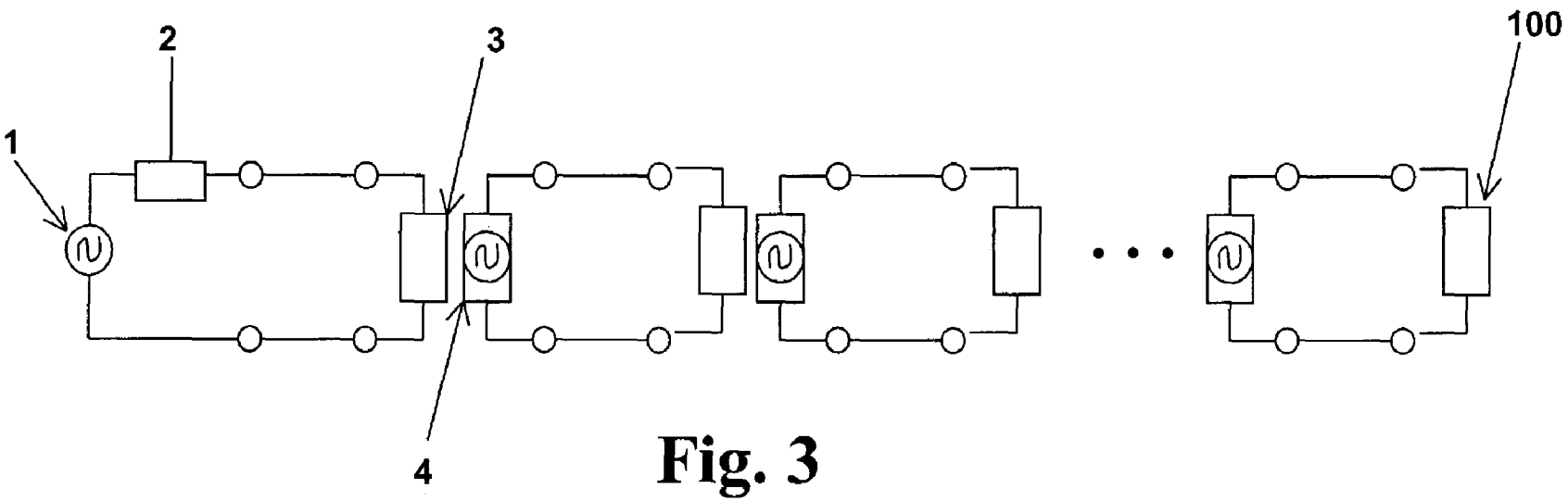
FIG. 3 is a schematic illustration of some of the elements of an inductive telemetry system.

By correctly designing inductive or capacitive pipe connections for matching impedances, the signal generator will drive the final termination with the highest possible efficiency. To drive an electrical signal along a wire (or wires) where the electrical length of the wire is greater than ¼ of the signal wavelength, terminations should be matched. FIG. 3 illustrates an example of the various electrical elements that may be used to propagate a signal inductively along a series of pipe lengths. In the figure, a signal is generated by a signal generator 1 and transmitted electrically along wire in a length of pipe to a signal transformer (transmitting coil) 3 positioned at the end of the length of pipe. The transmitting coil 3 then induces a similar signal in a different signal transformer (receiving coil) 4 at the end of an adjacent length of pipe. Signal is thus transmitted from pipe segment to pipe segment until the signal reaches a final termination 100. Although no signal propagation is without losses over distance, the losses can be reduced using the principles of the present invention.

The wire used for transmitting signal through various lengths of pipe is impedance matched from one length of pipe to another. Likewise, impedances from one transformer to another (or one capacitor to another, in the case of the capacitance embodiment) are substantially matched. A degree of additional optimization can be achieved by slightly increasing the number of windings in the transformer on the receiving side of each joint versus the number of windings in the transformer on the transmitting side, so that loss of signal is diminished or at least partially overcome. This represents a slight variation from the central principle of matching impedances throughout the system, yet in can yield an enhancement, especially where the remainder of the system elements are impedance matched as described elsewhere in this disclosure. According to one embodiment of the invention, using 90-foot pipe, a favorable degree of enhancement, especially when combined with the other principles of the invention described in this disclosure, is attained when the ratio of impedance between transformers across a joint is about 1:1.3. In practice, this degree of enhancement can be achieved using only about two or three more windings on the receiving side than on the transmitting side.

Ferrite Lined Recesses For purposes of this disclosure including the claims, the term "ferrite" is used to designate ferrite as well as other magnetic materials exhibiting the magnetic flux focusing characteristics referred to in this disclosure. Signal losses due to reflection, for example, can be further reduced through placing coils (in the embodiment of the invention using inductance as the mode of signal transmission between joints) or plates (in the embodiment of the invention using capacitance) in recesses lined with ferrite and (in the case of the inductance example) insulator material. In the inductance example, a combination of ferrite material and insulator material in proximity to the wire coils focuses the signal. Since changing magnetic flux is used to couple two coils together when induction is used to transmit signal from one coil to the next adjacent coil, coupling between two coils is diminished by the presence of iron or steel, which dissipates the energy in the magnetic flux. This dissipation, however, can be reduced through use of ferrite material in proximity to the wire coils, which acts like a magnetic flux amplifier and container. Results are further improved, for drilling and other downhole applications in which steel or iron pipe (which is, itself, magnetic) is used, by placing an additional non-magnetic, non-conductive material (such as plastic) between the ferrite material and the metal pipe at the joint. This material, by supplying a high resistance, breaks the magnetic circuit between the magnetic ferrite material and the iron or steel pipe.

Figure 4A:
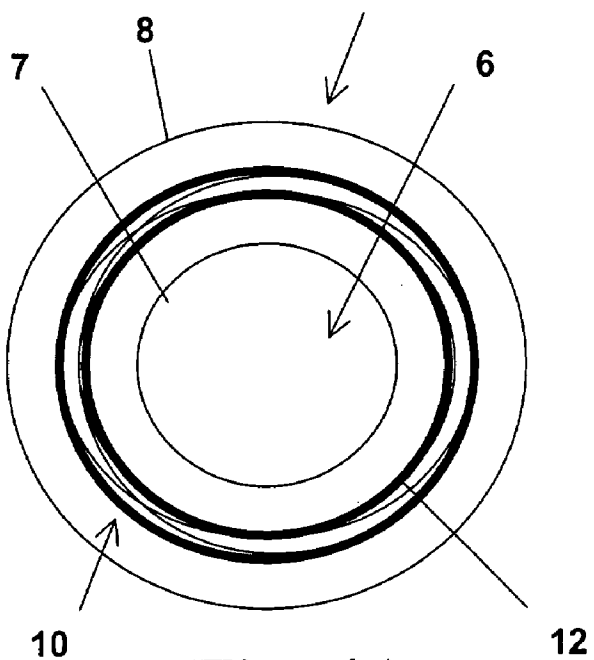
FIG. 4A is a schematic illustration of the end of a section of pipe that includes a shielded coil according to the principles of the invention.

FIG. 4A is a schematic illustration of the end of a section of pipe 5. The figure shows the central opening 6 that extends throughout the length of pipe as well as the inner surface edge 7 and the outer surface edge 8 of the pipe. Positioned between the inner surface edge 7 and the outer surface edge 8 is a pipe coil assembly 10 including a wire coil 12.

Figure 4B:
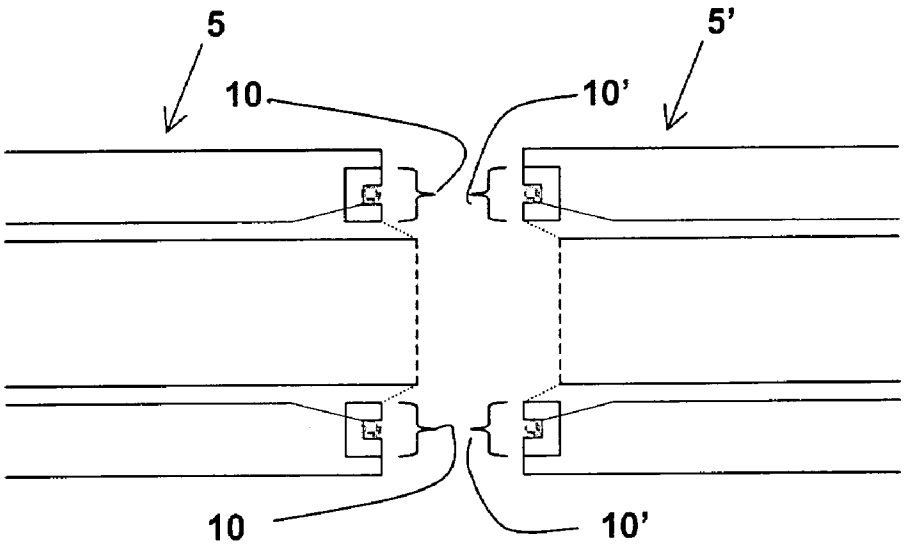
FIG. 4B illustrates, in cross section, two lengths of pipe incorporating the shielded coils.

FIG. 4B illustrates schematically a cross section of two threaded sections of pipe, 5 and 5', which in the figure are shown aligned in the position they would be in prior to being screwed together. In the figure, coil assemblies 10 and 10' are shown for both pipe sections, and it is apparent from the figure that, were the two pipe sections are assembled together, the two coil assemblies would lie in proximity, facing one another.

Figure 5A:
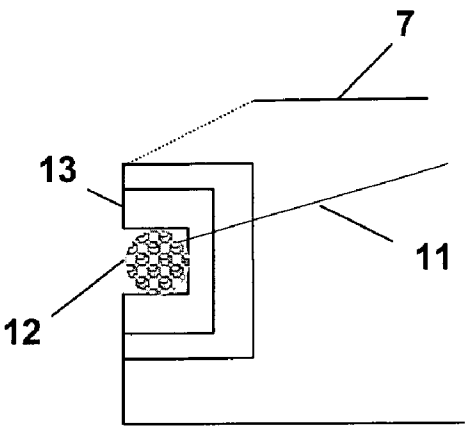
FIG. 5A shows added detail, in cross section, of a portion of pipe incorporating coil shielding according to the invention.

FIG. 5A shows added detail relating to a portion of one of the coil assemblies in the inductive coupled embodiment of the invention, and it demonstrates the positioning or wire in the coil assembly relative to the shielding features. In the figure, a wire coil 12 is positioned within a channel, bound, in this embodiment, on three sides by a magnetic (for example, ferrite) material 13 which, in turn is bound by an insulator material. Although the figures depict the magnetic material and the insulator material in shapes having a rectangular aspect with the ferrite material and insulator extending to the end of the pipe, other configurations, such as semicircular configurations, would likewise be suitable for the positioning of the magnetic and insulator material around the wire coil. It is considered that the claims herein are intended to capture all such reasonable and functional configurations, so long as in one aspect the coil is unbound and positioned so that it can communicate inductively with another coil positioned adjacent to it, while at the same time magnetic material and insulator material serves to substantially isolate the coil from other magnetic material (e.g. iron or steel) within or comprising the remainder of the pipe section. Also shown in the figure is a portion of wire 11, extending from the coil. Various positions are contemplated and possible for the portion of wire 11 outside of the coil that allow coils on opposite sides of a length of pipe to be connected electrically.

Figure 5B:
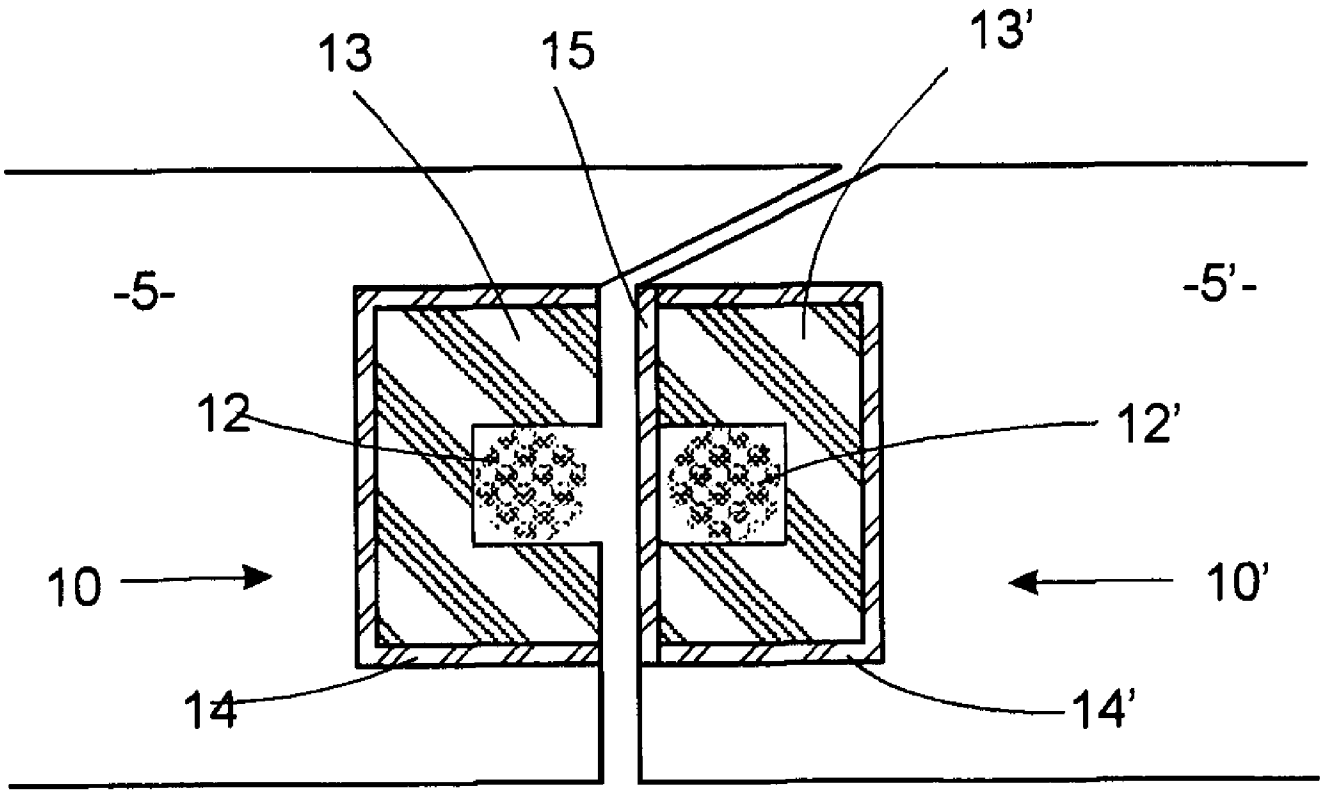
FIG. 5B likewise shows in cross section portions of pipe with coils and associated shielding, however, in this instance shielded coil segments from two assembled lengths of pipe are shown to illustrate their respective positions.

FIG. 5B illustrates, in cross section, two portions of facing coil assemblies 10 and 10' for two assembled sections of threaded pipe, 5 and 5'. When pipe joints are connected as shown in the figure, magnetic flux tends to stay mainly within the magnetic material 13, 13' adjacent to the facing coils 12, 12'.

By using impedance-matched wire in between pipe joints, inductive (or capacitive) signal transmission couplings at the joints that take advantage of a slightly higher impedance on the receiving transformer side of the joint, and coil assemblies incorporating the magnetic and insulating features described in this disclosure, signals can pass through many joints (perhaps more than thirty) before signal level is diminished appreciably. After that many joints, it may be necessary to amplify the signal. For the system described, single chip phase-lock-loop amplifiers are available commercially that could be readily adapted to drill pipe applications and built into drill pipe joints. Should such amplifiers be required for a given application, the number of active electronics required using the principles of the invention disclosed herein would be dramatically reduced, and the nature of the electronics can be cheap and robust.

It was noted earlier that various options exist for stringing wire from one end of a length of pipe to the other. In the field, if the wire comes loose, it is easily damaged and prevents passage of logging tools down the pipe. Past attempts at bonding (gluing) the wire to the drill pipe have not proved robust. Bonding is particularly difficult because of bending the pipe during drilling. Capillary tubes have been braised or welded inside the pipe to contain the wire, but this weakens the pipe.

A feature of the invention disclosed here is to use high-density polyethylene or other suitable material to line the pipe and provide support for wires adjacent to the inner surface of the pipe. This material protects the pipe from corrosion and smoothes the inside reducing friction to fluid flow. A desirable feature of polyethylene is that it is easily placed within the pipe by stretching it (to reduce its diameter) and then releasing the stretch after it is inside the pipe so that it expands to fill the pipe. In this way, communications wire can be secured between the inner surface of the pipe and the liner. Another desirable feature of such material is that as in insulator it minimizes heat transfer between the inside and outside of the drill pipe helping to cool downhole tools and bits and hardware.

Figure 6:
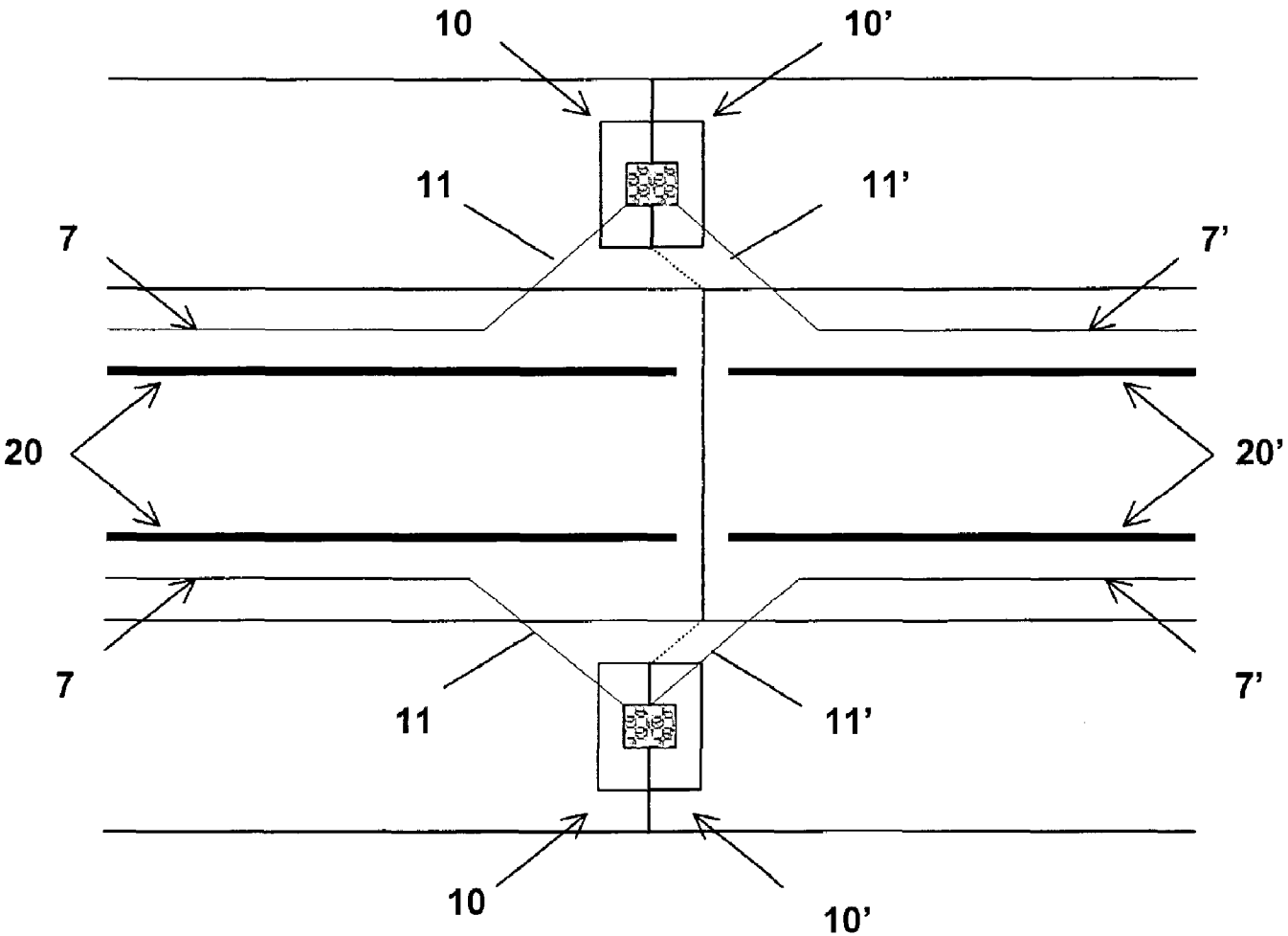
FIG. 6 illustrates, in cross section, an assembled joint between two sections of pipe, including a pipe liner securing wire according to the invention.

FIG. 6 illustrates, in cross-section an embodiment of this feature of the invention here disclosed, wherein a pipe liner is used to stabilize wire along the inner surface of the pipe. Although in practice, the wire, would be touching both the liner and the inner surface of the pipe, in FIG. 6, for convenience in understanding the respective positioning of elements, features of this aspect of the invention are illustrated schematically in a slightly exploded view.

As seen in the figure, wire 11 and 11' extending from the coils in the coil assemblies 10 and 10' enters the central opening 6 and 6' of two assembled lengths of pipe. (The wire passes through a feedthrough hole, not shown, in the pipe that may be filled, for example, with a pressure sealing material.) Also positioned in that central opening of each length of pipe is a polyethylene liner 20 and 20' situated so that the wire lies between the liner and the inner surface 7 and 7' of the pipe sections.

Bifilar (side by side) wire has been demonstrated to have properties favorable for high-speed telemetry. Such wire should not be affected by fluid in or around the pipe. This has been demonstrated by placing composite pipe with bifilar wire in a conductive brine solution. Advantages of bifilar wire are that it is off-the-shelf (thus relative cheap) and relatively small. It is suitable for placement between an internal liner and the drillpipe. It provides a base line for evaluating other wire options including coax and flat flex.

In one embodiment, the bifilar wire used as a baseline was a small 22 gage pair. Bifilar means that the wires are built with joining enameled coatings. Having the wires closely attached to each other helps to reduce external capacitance effects and provides a consistent signal path. Bifilar was chosen for this embodiment because of the reasons below with cost and availability given the highest considerations:

1. small in size, width is only 27 mils
2. Low resistance, <40 ohms per 1000 ft
3. have high insulation resistance
4. signal and signal return paths associated together
5. Cheap (lowest cost of all other alternatives) pennies per foot
6. Readily available For purposes of the present invention, twisted pair is very similar to bifilar, with the difference being that the two wires are twisted (or rolled) together to keep the external effects minimum and provide a consistent signal path. However, the act of twisting the wires causes the width and the height to be the same. Bifilar has the advantage of being able to lay flat to better fit into narrow places.

300-ohm antenna wire is similar to bifilar and would work inside the pipe in similar fashion. Bifilar wire, however, keeps the wires closer together to reduce external interference.

Coax, by design offers capacitance loading by choice of dielectric material between the center conductor and the outer conductor. This self-shielding design is the reason coax is used in the vast majority of all long cable designs. It does offer some disadvantages (for example, associated with its size) in wired pipe. If this disadvantages can be over come then it would be the cable of choice. Comparing coax with bifilar wire.

1. Large diameter, 50 mils
2. High resistance, ~100 ohms per 1000 ft because the center conductor is so small 30-32 agw
3. High insulation resistance
4. The best control of signal paths
5. Relatively expensive per foot cost, dimes per foot
6. Readily available Flat-Flex (Strip Line) cables are custom made for many industrial and commercial applications normally located inside control systems. One of the most common applications is inside inkjet printers and typewriters wherein they are used to conduct control signals to the moving print head.

Flat-Flex cables can be both multi-layer and multi-conductor. They can also be made to control characteristic impedances as coax. Flat-flex is used in military applications to replace coax in areas where there is not sufficient room for coax.

Comparing Flat-Flex with Bifilar:

1. Smallest thickness, 20 mils but 90 mils wide
2. Low resistance, comparable to bifilar
3. High insulation resistance
4. Improved control of signal paths given the width is much greater than the thickness
5. More expensive per foot cost, $1 or $2 per foot
6. Must be designed for this application Both bifilar and flat flex wire are suitable for placing in between an inner liner and drillpipe. Both bifilar and flat flex wire are also suitable for bonding to the drillpipe itself; clearly flatter wire can bonded to the drillpipe better than round (coax) or twisted pair. Flat flex has the advantage property of being flexible allowing it to bend with the drillpipe minimizing problems of breaking the conductor and debonding from the drillpipe, particularly when a flexible bonding agent is used. Combining bifilar or flat flex with an elastic internal liner allows the development of a system where the telemetry parts can be readily installed in and removed from existing drillpipe allowing the telemetry system to be moved form rig to rig without having to ship drillpipe.

EXAMPLE

Figure 7:
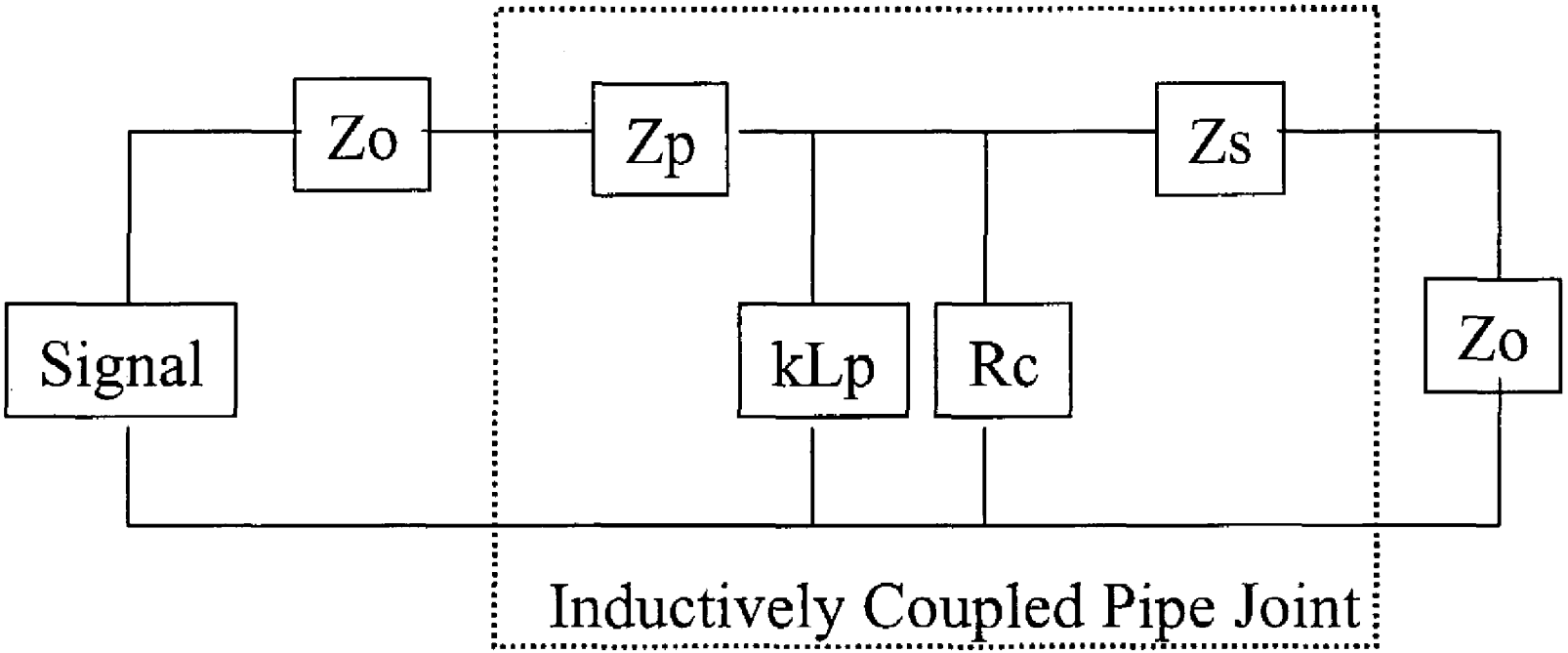
FIG. 7 is a schematic drawing showing aspects of an inductively coupled pipe joint. It shows impedances associated with the two inductive coils.

The following example illustrates various features of the invention. FIG. 7 is a schematic drawing showing aspects an inductively coupled pipe joint. It shows the impedances associated with the two inductive coils. These loops of wire create a transformer when the pipe joint is made up.

The following definitions are applicable to FIG. 7 and the description associated with this example:

Signal is the driving source of the transmission line.

Zo is the cable characteristic impedance of the transmission line, $=(L/C)^{1/2}$ Zp is the impedance of the primary side (input) of the transformer as a function of input coil shut capacitance, coil internal resistance and leakage inductance.

Zc is the coupling loss as a function of the coefficient (k) of coupling and core-loss Zs is the impedance of the secondary side (output) of the transformer as a function of the output shut capacitance, coil internal resistance and leakage inductance.

k is the Coefficient of coupling

Lp is the primary inductance

Rc is the core-loss equivalent shunt resistance

A (not shown) is the turns ratio=(Number of turns primary side)/(Number of turns secondary side)

Basic understanding and conventional inductive coupling of transmission lines:

The most efficient transmission line is one without any mismatches of the characteristic impedance, Zo. Mismatches cause signal loss through reflection of signal energy back toward the receiver. For transmission line, $Zo=(L/C)^{1/2}$, where L is the inductance and C the capacitance of the transmission line. Common Zo values are between 40 and 100 ohms for most transmission lines.

In the simple case of transformer coupled transmission lines the characteristic impedance is equal to $n^2Zo$. Thus the engineer having the same transmission line on both the primary and secondary sides of the inductively coupled transformer will use a turns ratio "a" equal to 1. Now, the characteristic impedance of the ideal transformer is exactly equal to Zo, the transmission line characteristic impedance. This results in no signal reflection or signal coupling loss. Remember, this ideal transformer ignores the values Zp, Zs, kLp and Rc shown in the above figure.

Conventional transmission line transformers have very low values for Zp and Zs due in part to the high frequencies transmission lines can carry. They also have very high coupling coefficient, 'k' using ferrite cores. In short, the ideal example above is common within the electronics industry.

However, core-loss 'Rc' for an inductively coupled transformer within a steel pipe joint is significant. The coupling coefficient 'k' is naturally poor. To best means for creating a useable transmission line within pipe joints, reduces the ill effects of the shunting variables Rc and kLp.

Magnetically Isolating the Transformer from the Iron/Steel Pipe Joint:

Core losses, Rc, are the effects of: hysteresis loss, eddy-current loss and residual loss. These losses will be extremely high in solid steel pipe. Two methods can help isolate the transformer coils from the steel pipe.

Ferrite Enclosure:

Placing ferrite material in a clam (or horseshoe) shape around each transformer windings will help isolate the inductive coils from the steel pipe. When the pipe joint is made up the transformer is enclosed within the ferrite material.

Ferrite material has an effective magnetic permeability without the conductivity of the metal pipe joint. This magnetic permeability helps create a magnetic circuit around the transformer coils increasing flux density and improving coupling at the high frequencies used in transmission lines.

Because magnetic lines of flux choose the easiest path, the majority will stay within the ferrite core. However, as shown in FIG. 5B, a second improvement will reduce core losses by creating a non-magnetic, non-conductive barrier 14, 14' between the ferrite 13, 13' and steel pipe 5, 5'. Any number of materials can be used here. The material can be very thin. One good candidate is a few millimeters of plastic or hard rubber.

This type of material creates what is called as air gap. This reduces the magnetic coupling between the ferrite and iron inside the drill pipe.

Using laminated layers of magnetic material in place of or in conjunction with ferrite material A slight variation on the ferrite material given above is to use laminated cores. Laminated cores are common practice in high power (low frequency) electric power industry. Laminated cores have a very high magnetic permeability and can be relatively strong. They are commonly subject to eddy currents using the non-conductive lamination to greatly reduce core conductivity. Most laminated cores are limited to very low frequencies 60 to 400 hz. However, 79 Permalloy™ in 0.000125-inch tape thickness may operate up to 1 MHz.

Controlling the Coupling Coefficient:

By constructing an inductive interface with a coupling coefficient constant with pipe joint temperature and wear, we can best correct the transformers characteristic impedance. The coupling coefficient is related to the effective permeability of the transformers core.

Creating a Fixed Gap in the Ferrite Joint Face

Making up the pipe joint magnetically connects the two halves of the transformer. However, in practical applications, high frequency ferrite materials are mechanically weak. As would be most materials compared to the pipe steel. It is not practical to have the ferrite material directly exposed. Also, pipe grease and other foreign materials would affect the mating ferrite materials.

A better solution is to slightly recess the two ferrite faces inside the pipe, as shown in FIG. 5B. This would provide room to place a surface material 15 better designed to take the shock and mechanical stresses of repeated pipe joint makeup. This recess should be less than the thickness of the ferrite barrier between the coil and steel pipe. It could be the same material 14 and thinness used in the gap between the ferrite material and steel pipe.

This recess reduces the effective permeability, $\mu_e$. Where $\mu_e = l_e\mu/[le+(\mu-1)l_g]$. $l_e$ is the effective core magnetic path length, $l_g$ is the distance recreated by the recess of the two ferrite sections surrounding the coils, $\mu$ is the ferrite material's permeability.

By building in a fixed gap in the ferrite face, the transformer will be more predictable because errors created by small amounts of joint grease or sand will have a reduced effect. By being able to control $\mu_e$ we can use the turns ratio 'a' to help correct the transformers characteristic impedance.

Matching the Transformers Characteristic Impedance to the Cable to Eliminate Signal Reflection:

Once the inductive coils are isolated from the steel pipe and the coupling coefficient is fixed then all that remains is matching the transformers characteristic impedance to the chosen transmission line.

This is can be done by altering the turns ratio, 'n'. For the pipe joint inductively coupled transformer the transformers characteristic impedance is calculate as shown below.

$Ztr=n^2(Zo+Zs)\|Zj+Zp$; Where Ztr is the transformers characteristic impedance, Zj is the combination of shut losses occurred by kLp and Rc. The double '||' lines are an electronic engineering convention to describe a parallel impedance of two variables.

This problem can be simplified by making the standard transformer assumptions that Zs and Zp are small errors. This is true for pipe joint inductive coupling, however, Zj is significant and can not be assumed zero.

Solving for n: $n=((ZjZtr)/(ZoZj-ZoZtr))^{1/2}$ The goal of this effort is to gain a Ztr close to the Zo of the cable. Setting Ztr=Zo we have $n=(Zj/(Zj-Zo))^{1/2}$. We know that n is a value greater than 1, which was the common general assumption given earlier for inductively coupling transmission lines.

Observations:

1. For improved impedance matching of inductively coupled signals in long transmission lines within drill pipe, the turns ratio of the coils is selected to match the impedance of the cable correcting for coupling losses at the pipe joints. This value is other than 1.

2. To reduce core-losses in inductively coupled drill pipe a ferrite material can be used to enclose the two transformer coils as the joint is made up.

3. To reduce core-losses in inductively coupled drill pipe laminated magnetic material can be used to enclose the two transformer coils as the joint is made up.

4. To reduce leakage magnetic flux from creating inductive losses in inductively coupled drill pipe joints the above ferrite or laminated magnetic material should have a non-magnetic, highly resistive material such as plastic or rubber isolating the ferrite or laminated magnetic material from the steel pipe joint.

5. To help keep the effective permeability of the inductively coupled pipe joint constant, a small recess can produce a small gap between the two halves of the ferrite or laminated magnetic material as the pipe joint is made up.

6. Any type of non-magnetic, highly resistive material can be used on the faces of the two pipe joints to protect the otherwise exposed ferrite or laminated magnetic material.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims.

We claim:

1. A drilling telemetry system comprising:

a plurality of communications packages in association with a plurality of drill pipe segments, each pipe segment having an outer surface, and an inner surface, and two ends bearing threads that enable the drill pipe segments to be assembled to form a drill pipe, with each communications package comprising:

i) a first wire coil, having a first impedance, adapted to function as an inductance transmitter, ii) a second wire coil, having a second impedance, adapted to function as an inductance receiver, iii) connecting wire, having a length and a third impedance, adapted to electrically adjoin the first wire coil to the second wire coil, iv) first and second insulating packages, each comprising a magnetic component and an electrically and magnetically insulating component and v) a polyethylene sleeve wherein the first wire coil is positioned at one end of a drill pipe segment, the second wire coil is positioned at the other end of the same drill pipe segment, the connecting wire is positioned so that at least a portion of its length lies between the polyethylene sleeve and the inner surface of the pipe segment, and further wherein first, second and third impedances for a given communications package contribute to a total impedance associated with that communications package that substantially matches total impedance associated with at least one other communications package in the drilling telemetry system.

2. A drill pipe containing an electrical signal transmission line comprising:

a plurality of segments of drill pipe formed of iron or steel tube, each segment having an outer surface and an inner surface and two circular ends that enable the drill pipe segments to be assembled to form a drill pipe with a first end of each segment adjacent and rigidly coupled to a second end of another segment with the inner surfaces of adjoining segments being aligned, each end of each segment additionally comprising:

i) an outer circular groove in said tube end, said outer groove having a groove surface extending into said end from an inner edge adjacent said inner surface to an outer edge adjacent said outer surface;

ii) a coil of electrical conductor in said groove;

iii) a ferrite material within said groove and spacing said coil from said groove surface; and iv) a nonmagnetic, electrically insulating mate spacing said ferrite material from said groove surface; and connecting wire electrically insulated from said pipe and electrically connecting the first wire coil to the second wire coil;

wherein when two pipes are assembled into a drill pipe, a coil and ferrite material at each of the connected ends of the pipes are adjacent and facing each other so that an electrical signal carried to one coil along its conductor is coupled to the facing coil for transmission along its conductor to another coil.

3. The drill pipe of claim 2 wherein said ferrite material and said insulator are recessed from the end of said pipe, the recess being covered by an electrically insulating material.

4. The drill pipe of claim 2 wherein said ferrite material and insulator extend to the end of said pipe.

5. The drill pipe of claim 2 wherein said insulator is plastic.

6. The drill pipe of claim 2 wherein said insulator is hard rubber.

* * * * *

UNITED STATES PATENT AND TRADEMARK OFFICE

CERTIFICATE OF CORRECTION

PATENT NO. : 7,362,235 B1
APPLICATION NO. : 10/438999
DATED : April 22, 2008
INVENTOR(S) : Randy A. Normann and Arthur J. Mansure It is certified that error appears in the above-identified patent and that said Letters Patent is hereby corrected as shown below:

On the Title Page, Item (73), the Assignee should read -- Sandia Corporation --.

Signed and Sealed this

Fifteenth Day of July, 2008

JON W. DUDAS
*Director of the United States Patent and Trademark Office*